US009316213B2

(12) United States Patent
Leskosek

(10) Patent No.: US 9,316,213 B2
(45) Date of Patent: Apr. 19, 2016

(54) PLASMA DRIVE

(71) Applicant: James Andrew Leskosek, Summerland (CA)

(72) Inventor: James Andrew Leskosek, Summerland (CA)

( * ) Notice: Subject to any disclaimer, the term of this patent is extended or adjusted under 35 U.S.C. 154(b) by 404 days.

(21) Appl. No.: 14/025,661

(22) Filed: Sep. 12, 2013

(65) Prior Publication Data

US 2016/0032906 A1 Feb. 4, 2016

(51) Int. Cl.
*F03H 1/00* (2006.01)

(52) U.S. Cl.
CPC ..... *F03H 1/0018* (2013.01); *F03H 1/0006* (2013.01); *F03H 1/0012* (2013.01); *F03H 1/0081* (2013.01); *F03H 1/0087* (2013.01); *F05D 2220/80* (2013.01)

(58) Field of Classification Search
CPC ... F03H 1/0006; F03H 1/0012; F03H 1/0018; F03H 1/0087
See application file for complete search history.

(56) References Cited

U.S. PATENT DOCUMENTS

| | | | | |
|---|---|---|---|---|
| 5,269,131 | A * | 12/1993 | Brophy | F03H 1/0043 60/202 |
| 6,279,314 | B1 * | 8/2001 | Valentian | F03H 1/0075 60/202 |
| 7,030,576 | B2 * | 4/2006 | McVey | F03H 1/0075 244/158.1 |
| 7,827,779 | B1 * | 11/2010 | Krishnan | F03H 1/0012 313/360.1 |
| 2003/0033797 | A1 * | 2/2003 | Spanjers | B64G 1/405 60/203.1 |
| 2006/0186837 | A1 * | 8/2006 | Hruby | F03H 1/0075 315/501 |
| 2008/0072565 | A1 * | 3/2008 | Bekey | F03H 1/005 60/203.1 |
| 2009/0056305 | A1 * | 3/2009 | Gilchrist | B64G 1/405 60/219 |

* cited by examiner

*Primary Examiner* — Phutthiwat Wongwian
*Assistant Examiner* — William Breazeal
(74) *Attorney, Agent, or Firm* — Antony C. Edwards

(57) ABSTRACT

A plasma drive includes a plurality of plasma thrusters arrayed in each of at least one array of plasma thrusters. Plasma thrust may be generated sequentially or in a pulse from each array. Circuitry is adapted to selectively fire each thruster in each array according to a digitally controlled progression. The controlled firing progression collectively provides a cumulative thrust vector for each array. In a turbine drive embodiment the controlled progression causes sequential firing of the thrusters in each array, and the arrays in sequence. The controlled progression allows for directional control of the combined cumulative thrust vectors.

18 Claims, 24 Drawing Sheets

Figure 4

Step Command

1. DO turbine position 1:

2. HIGH s1:5
3. PAUSE 1
4. LOW s3:28
5. PAUSE 1
6. HIGH s1:10
7. PAUSE 1
8. LOW s1:5
9. PAUSE 1
10. HIGH s1:15
11. PAUSE 1
12. LOW s1:10
13. PAUSE 1
14. HIGH s1:20
15. PAUSE 1
16. LOW s1:15
17. PAUSE 1
18. HIGH s1:25
19. PAUSE 1
20. LOW s1:20
21. PAUSE 1
22. HIGH s1:30
23. PAUSE 1
24. LOW s1:25
25. PAUSE 1

26. HIGH s2:6
27. PAUSE 1
28. LOW s1:30
29. PAUSE 1
30. HIGH s2:11
31. PAUSE 1
32. LOW s2:6
33. PAUSE 1
34. HIGH s2:16
35. PAUSE 1
36. LOW s2:11
37. PAUSE 1
38. HIGH s2:21
39. PAUSE 1
40. LOW s2:16
41. PAUSE 1
42. HIGH s2:26
43. PAUSE 1
44. LOW s2: 21
45. PAUSE 1
46. HIGH s2:1
47. PAUSE 1
48. LOW s2:26
49. PAUSE 1

50. HIGH s3:7
51. PAUSE 1
52. LOW s2:26
53. PAUSE 1
54. HIGH s3:12
55. PAUSE 1
56. LOW s3:7
57. PAUSE 1
58. HIGH s3:17
59. PAUSE 1
60. LOW s3:12
61. PAUSE 1
62. HIGH s3:22
63. PAUSE 1
64. LOW s3:17
65. PAUSE 1
66. HIGH s3:27
67. PAUSE 1
68. LOW s3:22
69. PAUSE 1
70. HIGH s3:2
71. PAUSE 1
72. LOW s3:27

73. PAUSE 50 turbine position 2:

74. HIGH s1:4
75. PAUSE 1
76. LOW s3:2
77. PAUSE 1
78. HIGH s1:9
79. PAUSE 1
80. LOW s1:4
81. PAUSE 1
82. HIGH s1:14
83. PAUSE 1
84. LOW s1:9
85. PAUSE 1
86. HIGH s1:19
87. PAUSE 1
88. LOW s1:14
89. PAUSE 1
90. HIGH s1:24
91. PAUSE 1
92. LOW s1:19
93. PAUSE 1
94. HIGH s1:29
95. PAUSE 1
96. LOW s1:24
97. PAUSE 1

98. HIGH s2:5
99. PAUSE 1
100. LOW s1:29
101. PAUSE 1
102. HIGH s2:10
103. PAUSE 1
104. LOW s2:5
105. PAUSE 1
106. HIGH s2:15
107. PAUSE 1
108. LOW s2:10
109. PAUSE 1
110. HIGH s2:20
111. PAUSE 1
112. LOW s2:15
113. PAUSE 1
114. HIGH s2:25
115. PAUSE 1
116. LOW s2: 20
117. PAUSE 1
118. HIGH s2:30
119. PAUSE 1
120. LOW s2:25
121. PAUSE 1

Figure 4A

122. HIGH s3:6
123. PAUSE 1
124. LOW s2:25
125. PAUSE 1
126. HIGH s3:11
127. PAUSE 1
128. LOW s3:6
129. PAUSE 1
130. HIGH s3:16
131. PAUSE 1
132. LOW s3:11
133. PAUSE 1
134. HIGH s3:21
135. PAUSE 1
136. LOW s3:16
137. PAUSE 1
138. HIGH s3:26
139. PAUSE 1
140. LOW s3:21
141. PAUSE 1
142. HIGH s3:1
143. PAUSE 1
144. LOW s3:26
145. PAUSE 50 turbine position 3:

146. HIGH s1:3
147. PAUSE 1
148. LOW s3:1
149. PAUSE 1
150. HIGH s1:8
151. PAUSE 1
152. LOW s1:3
153. PAUSE 1
154. HIGH s1:13
155. PAUSE 1
156. LOW s1:8
157. PAUSE 1
158. HIGH s1:18
159. PAUSE 1
160. LOW s1:13
161. PAUSE 1
162. HIGH s1:23
163. PAUSE 1
164. LOW s1:18
165. PAUSE 1
166. HIGH s1:28
167. PAUSE 1
168. LOW s1:23
169. PAUSE 1
170. HIGH s2:4
171. PAUSE 1
172. LOW s1:28
173. PAUSE 1
174. HIGH s2:9
175. PAUSE 1
176. LOW s2:4
177. PAUSE 1
178. HIGH s2:14
179. PAUSE 1
180. LOW s2:9
181. PAUSE 1
182. HIGH s2:19
183. PAUSE 1
184. LOW s2:14
185. PAUSE 1
186. HIGH s2:24
187. PAUSE 1
188. LOW s2: 19
189. PAUSE 1
190. HIGH s2:29
191. PAUSE 1
192. LOW s2:24
193. PAUSE 1
194. HIGH s3:5
195. PAUSE 1
196. LOW s2:24
197. PAUSE 1
198. HIGH s3:10
199. PAUSE 1
200. LOW s3:5
201. PAUSE 1
202. HIGH s3:15
203. PAUSE 1
204. LOW s3:10
205. PAUSE 1
206. HIGH s3:20
207. PAUSE 1
208. LOW s3:15
209. PAUSE 1
210. HIGH s3:25
211. PAUSE 1
212. LOW s3:20
213. PAUSE 1
214. HIGH s3:30
215. PAUSE 1
216. LOW s3:25
217. PAUSE 50 turbine position 4:

218. HIGH s1:2
219. PAUSE 1
220. LOW s3:30
221. PAUSE 1
222. HIGH s1:7
223. PAUSE 1
224. LOW s1:2
225. PAUSE 1
226. HIGH s1:12
227. PAUSE 1
228. LOW s1:7
229. PAUSE 1
230. HIGH s1:17
231. PAUSE 1
232. LOW s1:12
233. PAUSE 1
234. HIGH s1:22
235. PAUSE 1
236. LOW s1:17
237. PAUSE 1
238. HIGH s1:27
239. PAUSE 1
240. LOW s1:22

Figure 4B

241. PAUSE 1

242. HIGH s2:3

243. PAUSE 1

244. LOW s1:27

245. PAUSE 1

246. HIGH s2:8

247. PAUSE 1

248. LOW s2:3

249. PAUSE 1

250. HIGH s2:13

251. PAUSE 1

252. LOW s2:8

253. PAUSE 1

254. HIGH s2:18

255. PAUSE 1

256. LOW s2:13

257. PAUSE 1

258. HIGH s2:23

259. PAUSE 1

260. LOW s2: 18

261. PAUSE 1

262. HIGH s2:28

263. PAUSE 1

264. LOW s2:23

265. PAUSE 1

266. HIGH s3:4

267. PAUSE 1

268. LOW s2:28

269. PAUSE 1

270. HIGH s3:9

271. PAUSE 1

272. LOW s3:4

273. PAUSE 1

274. HIGH s3:14

275. PAUSE 1

276. LOW s3:9

277. PAUSE 1

278. HIGH s3:19

279. PAUSE 1

280. LOW s3:14

281. PAUSE 1

282. HIGH s3:24

283. PAUSE 1

284. LOW s3:19

285. PAUSE 1

286. HIGH s3:29

287. PAUSE 1

288. LOW s3:24

289. PAUSE 50

<u>turbine position 5:</u>

290. HIGH s1:1

291. PAUSE 1

292. LOW s3:29

293. PAUSE 1

294. HIGH s1:6

295. PAUSE 1

296. LOW s1:1

297. PAUSE 1

298. HIGH s1:11

299. PAUSE 1

300. LOW s1:6

301. PAUSE 1

302. HIGH s1:16

303. PAUSE 1

304. LOW s1:11

305. PAUSE 1

306. HIGH s1:21

307. PAUSE 1

308. LOW s1:16

309. PAUSE 1

310. HIGH s1:26

311. PAUSE 1

312. LOW s1:21

313. PAUSE 1

314. HIGH s2:2

315. PAUSE 1

316. LOW s1:26

317. PAUSE 1

318. HIGH s2:7

319. PAUSE 1

320. LOW s2:2

321. PAUSE 1

322. HIGH s2:12

323. PAUSE 1

324. LOW s2:7

325. PAUSE 1

326. HIGH s2:17

327. PAUSE 1

328. LOW s2:12

329. PAUSE 1

330. HIGH s2:22

331. PAUSE 1

332. LOW s2: 17

333. PAUSE 1

334. HIGH s2:27

335. PAUSE 1

336. LOW s2:22

337. PAUSE 1

338. HIGH s3:3

339. PAUSE 1

340. LOW s2:22

341. PAUSE 1

342. HIGH s3:8

343. PAUSE 1

344. LOW s3:3

345. PAUSE 1

346. HIGH s3:13

347. PAUSE 1

348. LOW s3:8

349. PAUSE 1

350. HIGH s3:18

351. PAUSE 1

352. LOW s3:13

353. PAUSE 1

354. HIGH s3:23

355. PAUSE 1

356. LOW s3:18

357. PAUSE 1

358. HIGH s3:28

359. PAUSE 1

360. LOW s3:23

361. PAUSE 50

362. loop

PLASMA DRIVE

FIELD OF THE INVENTION

This invention relates to the field of plasma thrusters and in particular to a plasma drive having at least one substantially planar array of plasma thrusters which are fired sequentially.

BACKGROUND OF THE INVENTION

A Pulsed Plasma Thruster (PPT), also known as a plasma jet engine, is a form of electric propulsion which is known in the prior art. Most PPTs use a solid fuel propellant, although reportedly a minority use liquid or gaseous propellants. As seen in the illustration given by way of example in FIG. 1, the first stage in PPT operation involves an arc of electricity passing through the fuel, causing ablation and sublimation of the fuel. The heat generated by this arc causes the resultant gas to turn into plasma, thereby creating a charged gas cloud. Due to the force of the ablation, the plasma is propelled at low speed between two charged plates (an anode and cathode). Since the plasma is charged, it effectively completes the circuit between the two plates, allowing a pulse of current to flow through the plasma. The energy used in each pulse is stored in a capacitor. The flow of electrons generates a strong electromagnetic field which then exerts a Lorentz force on the plasma, accelerating the plasma out of the PPT exhaust at high velocity. The pulsing occurs due to the time needed to recharge the plates following each burst of fuel, and the time between each arc. The frequency of the pulsing is normally very high and so it generates an almost continuous and smooth thrust. While the thrust is very low, a PPT can operate continuously for extended periods of time, yielding a large final acceleration. By varying the time between each capacitor discharge, the thrust and power draw of the PPT can be varied.

SUMMARY OF THE INVENTION

In Summary the plasma drive according to one aspect of the invention may be characterized as including a plurality of plasma thrusters arrayed in each of at least one array of plasma thrusters. When there are a plurality of arrays of plasma thrusters, the arrays are adapted to provide plasma thrust sequentially or in a pulse from each array in the plurality of arrays so that a plasma thrust associated with each plasma thruster, when energized, in each array has a cumulative thrust vector in a desired thrust direction. Circuitry is operatively associated with each array. The circuitry is adapted to selectively energize and de-energize each thruster in each array according to a controlled progression, controlled by a digital processor. The controlled progression causes energizing and de-energizing of each plasma thruster in each array so as to collectively provide the cumulative thrust vector for each array, and wherein in a turbine drive embodiment the controlled progression causes sequential energizing and de-energizing of the thrusters in each array, and the plurality of arrays in sequence. The controlled progression allows for directional control of the cumulative thrust vector through the plurality arrays, for example when the plurality of arrays form a cube or other three dimensional shape having sufficient depth through the stack of arrays.

In one enforcement, each array is substantially planar, and each array is substantially parallel to a next adjacent array in the plurality of arrays. In such an embodiment, or in embodiments wherein the arrays are non-planar, the plasma thrusters in each array may be organized according to an arrangement chosen from the group of arrangements comprising: a conic section, a grid, side-by-side conic sections, side-by-side grids, concentric conic sections, and a combination of concentric and side-by-side conic sections, wherein the conic sections include circles.

In order to form the three dimensional shape of the stack of arrays, each array overlaps a next adjacent array in the plurality of arrays so that the cumulative thrust vectors for each array are substantially parallel. In some embodiments, for example where there is no directional control of the thrust vector being implemented so that the thrust vector is orthogonal to the planes of the arrays, the cumulative thrust vectors may be substantially co-linear. In such embodiments each array may be substantially symmetrical in its plane about the corresponding cumulative thrust vector.

In the conic section arrangement, each array is arranged in substantially a ring or circle. In the grid arrangement, each array is substantially arranged as at least one tetragon. For example, the tetragon may be a trapezoid. The trapezoid may be substantially rectangular.

In a preferred embodiment the controlled progression includes a sequence which energizes a first thruster in a first array then sequentially energizes a second thruster and de-energizes the first thruster, and then sequentially energizes a third thruster and de-energizes the second thruster and so on until some or all thrusters including a last thruster in the first array have been sequentially energized. If the first array, is the only array then the sequence returns to then energize the first thruster in the first array and continue the sequence of energizing from the first thruster to the last thruster in a continuous loop. If there are a plurality of arrays then once the sequence completes sequentially energizing some or all thrusters in the first array then the sequence progresses to a first thruster of a second array and sequentially energizes some or all thrusters in the second array, and so on through some or all arrays in the plurality of arrays, whereupon the sequence returns to the first array and the sequence repeats itself continuously according to the controlled progression. All of the plurality of arrays may be energized and de-energized sequentially or substantially simultaneously or in other patterns to relieve directional thrust control under the controlled progression.

In certain embodiments, each plasma thruster may be electrically actuated by at least one plasma gate, and wherein each plasma gate includes:

(a) at least one conductive input line having a corresponding at least one terminal end;

(b) a plurality of conductive output lines having a corresponding plurality of input ends;

(c) a plasma gate gap having opposite first and second ends, wherein the plasma gate gap extends between the at least one terminal end and the plurality of input ends, and wherein a plasma-generating gas is resident in the plasma gate gap;

(d) at least one field generator having a field-generating distal end mounted so as to position the distal end adjacent the plasma gate gap, wherein the plurality of conductive output lines are arrayed along the plasma gate gap in a spaced apart array, and the distal end is positioned at least at the first end of the plasma gate gap.

In one embodiment the plasma gate gap may be elongate and the at least one conductive input line is an array of conductive input lines and wherein consequently the at least one terminal end is a corresponding array of terminal ends corresponding to the array of conductive input lines, and wherein the plurality of input ends correspond to, and are substantially aligned with, the array of terminal ends. For example, the plasma gate gap may be substantially linear.

BRIEF DESCRIPTION OF THE DRAWINGS

FIG. 4 is a listing of one example of an algorithm for sequentially energizing and de-energizing the plasma thrusters of the three stage of plasma drive of FIG. 2.

FIG. 4A is a second page of the listing of FIG. 4.

FIG. 4B is a third page of the listing of FIG. 4.

DETAILED DESCRIPTION OF EMBODIMENTS OF THE INVENTION

Plasma Drive

Figure 1:
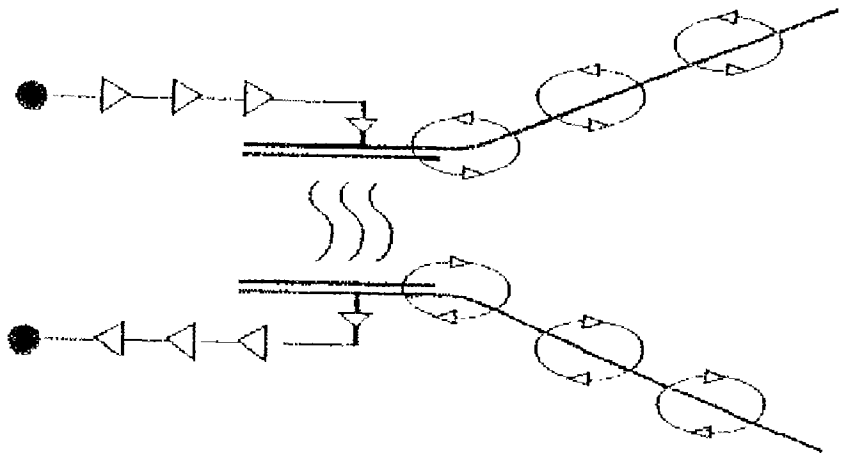
Fig 1 PRIOR ART
FIG. 1 is a diagrammatic view of a prior art pulse plasma thruster.

In one embodiment of the plasma drive described and claimed herein, an array of plasma generators or plasma thrusters (herein referred to as PT's) are arranged around at least one stage, wherein as used herein the term stage is not meant to be limiting. PT's around each stage are triggered, fired or pulsed sequentially to generate thrust which is substantially cumulatively parallel from each PT. Over each stage then thrust is generated quasi-continuously depending on design cycle timing, as better described below, as each PT in the stage is sequentially fired in a first embodiment, and in a second embodiment, substantially simultaneously fired. The plasma drive may have one, and preferably more than one stage. In one embodiment the plasma drive has multiple stages, which are arranged in layers and stacked more or less tightly adjacent to one another. The PTs in each stage are fired, not only sequentially within each stage in the first embodiment, but the stages may be fired sequentially one after the other so as to continuously cycle through the stages and through the PT's within each stage. In the second embodiment the stages may also be fired sequentially one after the other so as to continuously cycle through the stages. In the description that follows, the first embodiment is also referred to as a turbine drive, and the second embodiment is also referred to a pulse drive.

Each stage in either the turbine drive or pulse drive may for example have a ring or grid lay-out of its PTs. Advantageously each PT has an address, for example which includes the stage number and the PT number or its corresponding electrical pin number within that stage. In embodiments having one or more rings of PTs in each stage, the PT numbers may be assigned sequentially around the circumference of each ring so that each PT has a unique address. Where each stage has a grid of PTs, again each PT advantageously is assigned a unique address, and in the turbine drive the sequence of firing of the PTs may proceed in a progression sequentially along the addresses.

Each stage, or array of PT's, may lie in what is substantially a planar arrangement, although this is not intended to be limiting as other arrangements, for example a plurality of inter-twined helixes such as a counter-directional double helix may also work. Thus a "stage" may be for example a section of a more-or-less continuous helix or double helix, etc., and thus not necessarily planar.

In embodiments wherein the arrays or stages are planar, the cathode and anode, that is, the electrodes, of each PT lie substantially in the plane containing the array, that is, in the plane of the ring or grid of PTs in each stage so that the thrust vector for each PT is substantially parallel and orthogonal to the plane. In non-planar stages, for example where a stage is a section of a helix or double helix, the electrodes of each PT may lie substantially in the three-dimensional thickness of the body of the helix or double helix. The reference to a counter rotational double helix is meant to refer to two helixes that fire their PTs counter-rotationally so that any torque from firing one helix counters the torque from the other helix.

In the ring embodiments of the plasma drive wherein the PT's in each stage are arranged in at least one ring, and each ring overlays the corresponding rings in adjacent stages, in the turbine drive the PTs in each stage are fired (that is, energized and de-energized) in a sequential progression around the ring or rings in the first stage, followed by firing of the PT's in sequential progression around the ring or rings in the next stage and so on sequentially through each stage, whereupon, after the final PT firing in the final stage, the firing returns to the first stage. In the pulse drive the PT's in each ring or grid in each stage are fired (that is energized and then de-energized), substantially simultaneously, and each stage fired sequentially to provide a "pulse" of thrust.

In the turbine drive, where the PT's have sequential addresses around each ring in each stage, in one embodiment, where in a first stage S1 a certain PT (given by way of example address "n" in the ring) is fired first in the sequential progression around that ring, once the sequence around that ring has been fired then the PT firing sequence commences in the corresponding, axially aligned ring aligned along its thrust axis in the next stage S2. Where the PT's have corresponding addresses around the second ring, that is the aligned ring in the next stage, the first PT to fire is, for example, at the address "n+1", that is, offset by one PT around the ring in the second stage S2 as compared to the location of the first ("n") PT to fire in the first stage S1. Again, the offset between stages may be by one or more PT's. In embodiments having more than two stages, the location of each first-to-fire PT may be offset in each successive stage relative to the location of the first-to-fire PT in the preceding stage.

Figure 2:
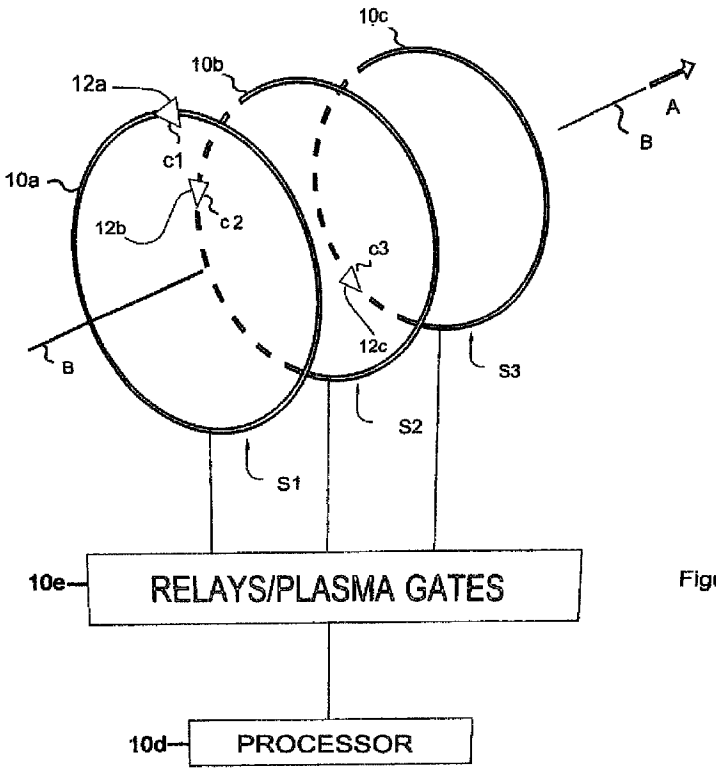
FIG. 2 is a diagrammatic view of a three stage plasma thruster ring embodiment of a plasma drive.

Thus it will be appreciated that, in the ring array embodiments wherein the PTs in each stage are arrayed in one or more rings, and wherein the ring or rings in each stage are correspondingly aligned with the ring or rings in the other stage or stages, the firing pattern of the PTs for each set of corresponding rings in the adjacent stages in the stack of stages will, in the turbine drive embodiment, resemble a stepped helix. That is, the firing pattern in each stage will be circular and sequential around the rings, and the rings will fire in successive sequence from stage to stage. This is represented in FIG. 2 as a series of stacked stages or rings (10*a*, 10*b*, 10*c*) which represent the "stepped helix" firing pattern trajectory in each of the successive stages S1, S2, and S3. A processor 10*d* controls the controlled progression of the relays or plasma gates 10*e* corresponding to the PT's within each stage. The illustration of three stages is by way of example, as more or less stages may be used. Processor 10*d* may thus be programmed to exclude from the firing sequence any failed components for example failed PT's, failed relays or plasma gates, failed stages, etcetera, or may be programmed for other firing sequences within stages or between stages. The firing sequence may also be adjusted so as to selectively alter the direction of the cumulative thrust.

The location of the corresponding arrow heads 12*a*, 12*b* and 12*c* in FIG. 2 generally represents the offset positions of the first-to-fire PT in each successive stage S1, S2, and S3. The illustrated location of each arrow head is by way of example and not intended to be limiting. The cumulative thrust is illustrated in FIG. 2 as generated in direction A by the plasma drive, which represents the collective or combined thrust direction along thrust axis B, wherein in the example of FIG. 2 axis B is common and concentric to all three rings 10*a*-10*c*.

Figure 6:
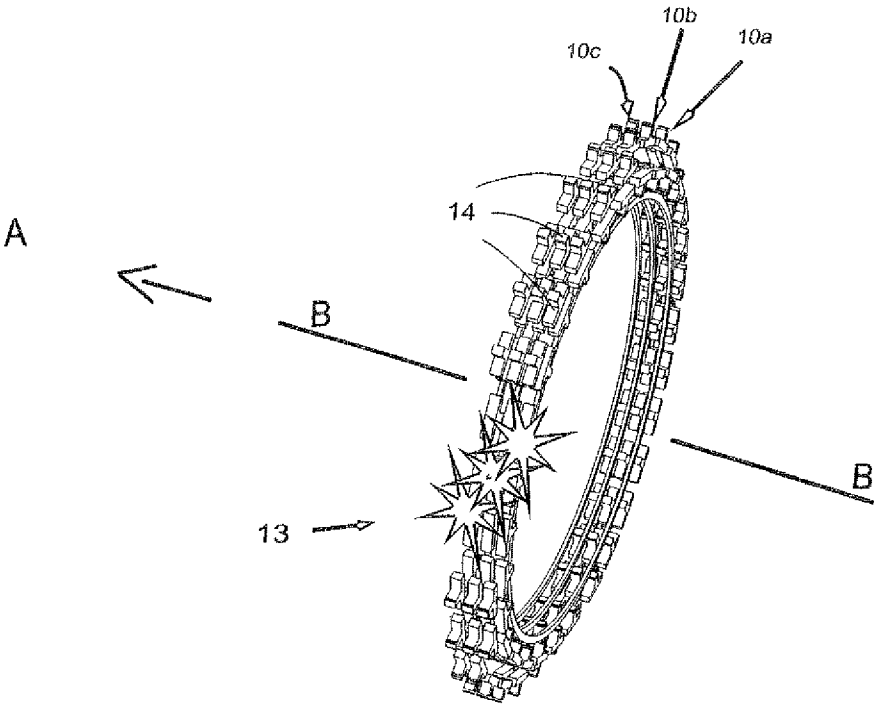
FIG. 6 is, in perspective view, the three plasma thruster rings of FIG. 5 in an unexploded view.

The stacked pattern of the three rings, and variants thereof, illustrate what is referred to above as a stepped helix or as one embodiment of a turbine drive. The PTs around ring 10*a* fire in sequence around ring 10*a* in direction C1 followed in sequence and seamlessly, by the firing of the PTs around ring 10*b* in direction C2, then followed in sequence, and seamlessly, by the firing of the PTs around ring 10*e* in direction C3 , and so on for all of the stages present if there were more than three stages. It is understood that the illustrations herein showing the use of three stages is meant to be by way of example only and not limiting. The staggered and offset firing of the first PT's in each of these stages is illustrated in FIG. 6, wherein the stages are assembled adjacent to one another and directly overlapping. The firing of the PTs is represented by starburst shaped icons 13.

Figure 3:
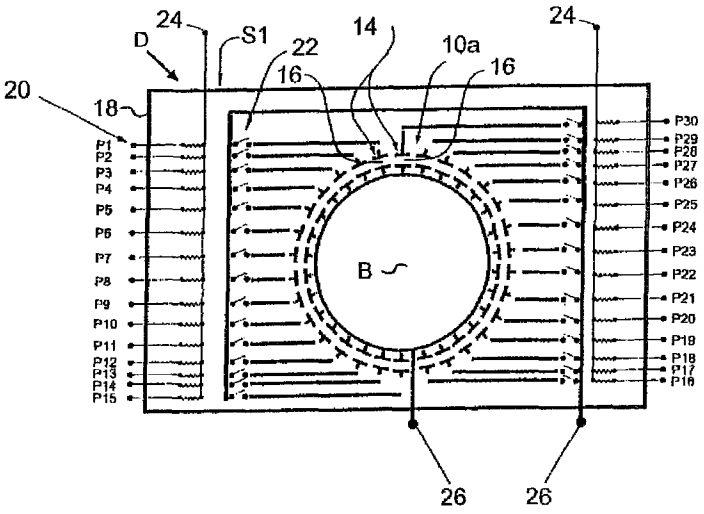
FIG. 3 is a diagrammatic circuit diagram of the first stage of the plasma drive of FIG. 2.

As seen in FIG. 3, a single stage, such as stage S1, includes a ring 10*a* of PTs 14 arranged in a radially spaced array, evenly radially spaced around axis B so as to provide plasma thrust in direction A, which, in the example of FIG. 3, is a directed perpendicularly out of the plane of the view of FIG. 3. Each PT 14 has spaced apart electrodes 14*a* and 14*b*, which, when energized, provide an arc of electricity which passes between the electrodes to thereby ionize the gas or other plasma fuel propellant located between the electrodes. Thus ionization occurs in the gap 16 between electrodes 14*a* and 14*b* of each PT 14.

In the illustrated example, thirty PTs are arranged around the circumference of ring 10*a*. If ring 10*a* is described as lying in plane D which in the illustration happens to be defined by the ring circuit 18, then it may be said that ring 10*a*, and the PTs 14 forming ring 10*a*, also lie within plane D. Thus the thrust generated by the acceleration of plasma from within gaps 16 of each energized PT 14 are accelerated in directions, cumulatively direction A, which are parallel to thrust axis B. In the illustrated example, although thirty PTs 14 are shown, it will be understood that depending on the diameter of ring 10*a*, and the size of each PT 14, a lesser or greater number of PTs 14 may form ring 10*a*.

The remainder of the diagram of FIG. 3 illustrates, diagrammatically, one example of the circuitry used to sequentially energize PTs 14 around ring 10*a*. Thus each PT 14 has a corresponding IO (input/output) pin 20, labelled correspondingly and individually as pins P1-P30. Each IO pin of pins P1-P30 have corresponding relays 22. In the illustrated example which is not intended to be limiting, relays 22 provide for the selective energizing of electrodes 14*a* and 14*b*. In one embodiment relays 22 may be grounded at ground 24 and power supplied to the electrodes via power supplies 26. as would be known to one skilled in the art, reference number 26 may also indicate ground if the power supply is reversed. Alternating current may also be employed.

Figure 5:
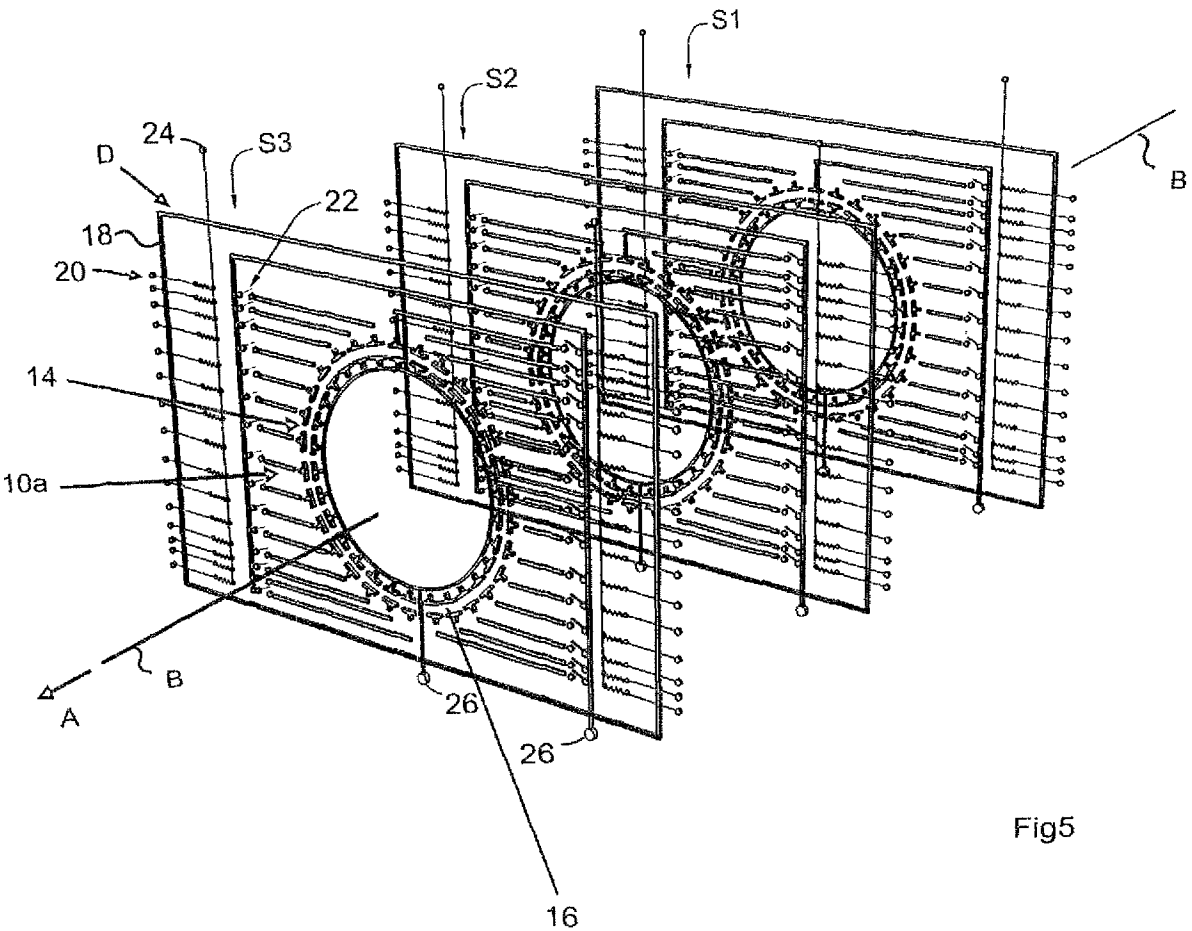
FIG. 5 is, in exploded perspective view, the three stage plasma drive embodiment of FIG. 2 using the circuits of FIG. 3 for each stage.

In a preferred embodiment, the energizing of PTs 14 is controlled by an algorithm such as set out by way of example in FIG. 4 which shows a listing of an algorithm in the P BASIC code language. The algorithm sequentially energizes and de-energizes PTs 14 in a sequence around ring 10*a*. By way of example, the algorithm initially energizes sequentially, pins P5, P10, P15, P20, P25, and P30. The energizing of the sequence is separated by pauses while energized of a single processing cycle time. Thus in the coding of FIG. 4, the instruction "do" in step one means start. In FIG. 4 the instruction "high" means energized or "on", the instruction "pause" means maintain the energizing longer, wherein the number associated with the pause instruction is the number of processing cycles, and the instruction "low" means de-energize or "off". Using PBASIC, one may employ three microcontrollers, that is, one for each S1, S2, and S3. Therefore in this example, each microcontroller would for example execute an algorithm instruction "high 5." Thus as seen in step two the result for stage S1 would be to energize stage 1, pin P5. As indicated in the next line of code (step three), pin P5 is left energized for a pause of one processing cycle. Pin P10 is subsequently energized in step six and while pin P10 is energized pin PS is de-energized in step eight, and so on sequentially. The coding of FIG. 4 is for a three stage plasma drive such as illustrated in FIGS. 5, 6, and 8 so that, as one skilled in the art would appreciate on reviewing the algorithm of FIG. 4, once pins P5, P10, P15, P20, P25 and P30 have been sequentially energized and de-energized, then the sequence of energizing the pins and corresponding PTs 14 switches seamlessly to energizing the PTs 14 of the second stage S2, and so on, wherein stages S2 and S3 are substantially identical to stage S1. Thus once pin P30 in stage S1 has been energized, the next pin to be energized in the example of FIG. 4 is pin P6 of stage S2, following which pin 30 of stage S1 is de-energized. Thus it will be noted that the pin which is energized in stage S2 is offset around the ring to the next adjacent PT 14 (ie in the n+1 position) as compared to the PT 14 which was first energized in stage 1 (the PT corresponding to P5 on stage S1). The sequential energizing of PTs 14 in ring lob, that is within the ring of PTs 14 within stage S2, then continues in the same progression sequence as that of the progression of energizing of pins 20 around ring 10*a* of stage S1. Thus, in the example of FIG. 4 pins P6, P11, P16, P21, P26 and P1 are sequentially energized and de-energized in stage S2. Once the last pin 20 and corresponding PT 14 is energized in stage S2 (pin S2:1 in the example of FIG. 4) then the sequential energizing progression switches to stage S3 wherein in the example of FIG. 4 pins P7, P12, P17, P22, P27, and P2 are sequentially energized.

Once the sequential energizing progression is completed in stage S3, the algorithm executes a "loop" instruction (the very last step of FIG. 4) to loop back to continuing the sequential energizing progression in stage S1, and so on in a continuous sequential progression looping through the three stages.

Figure 8A:
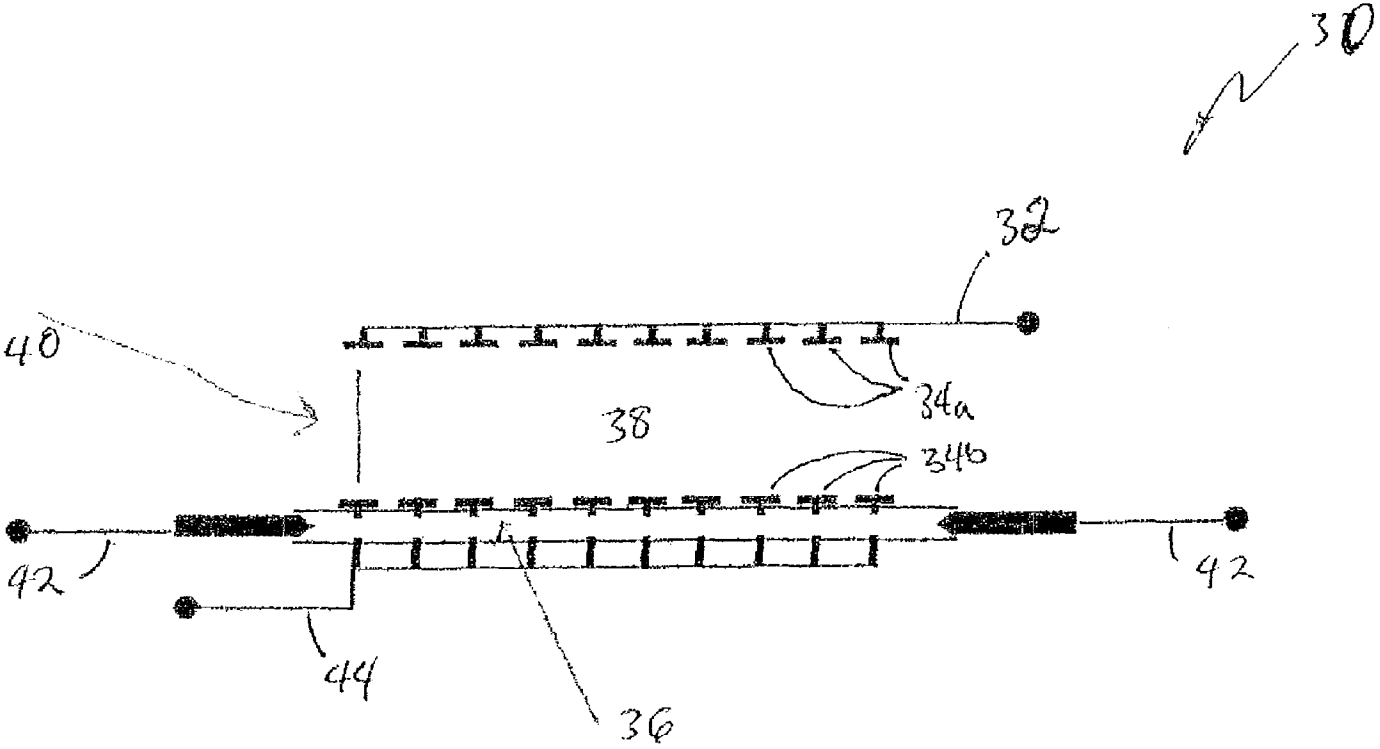
FIG. 8*a* is a diagrammatic view of plasma gates integrated into each electrode of a plasma thruster.

In an alternative embodiment, electrodes may be carbon electrodes, and further, relays 22 may be replaced by, or combined as a hybrid such as seen in FIG. 8*a* with, the use of plasma gates such as described in my co-pending PCT Application No. PCT/CA2012/001057 filed Nov. 15, 2012 entitled Plasma Gate which is incorporated herein by reference and described below. With regard to the use of carbon electrodes, applicant has observed a relative increase in the radiation of thermal energy when using carbon electrodes. With regard to the use of plasma gates instead of relays, the use of plasma gates may allow a higher frequency or firing rate, allowing the production of greater energy and thrust, and may reduce the amount of circuitry or wiring required. Plasma gates may also allow for a higher density (a greater number of PT's per stage size) and a higher resolution (more PT's per area).

Although stages S1-S3 are shown spaced apart from one another in FIG. 5, this depiction is for ease of viewing, as stages S1-S3 may advantageously be closely packed together so as to overlay one another in a closely adjacent array stacked along thrust axis B so that each of rings 10*a*-10*c* are symmetrically concentric about thrust axis B such as seen in FIG. 6. For each stage, although not illustrated for sake of clarity of the views, there may be multiple rings in each stage which may be arranged side-by-side or concentrically, or a combination of both arrangements.

Figure 7A:
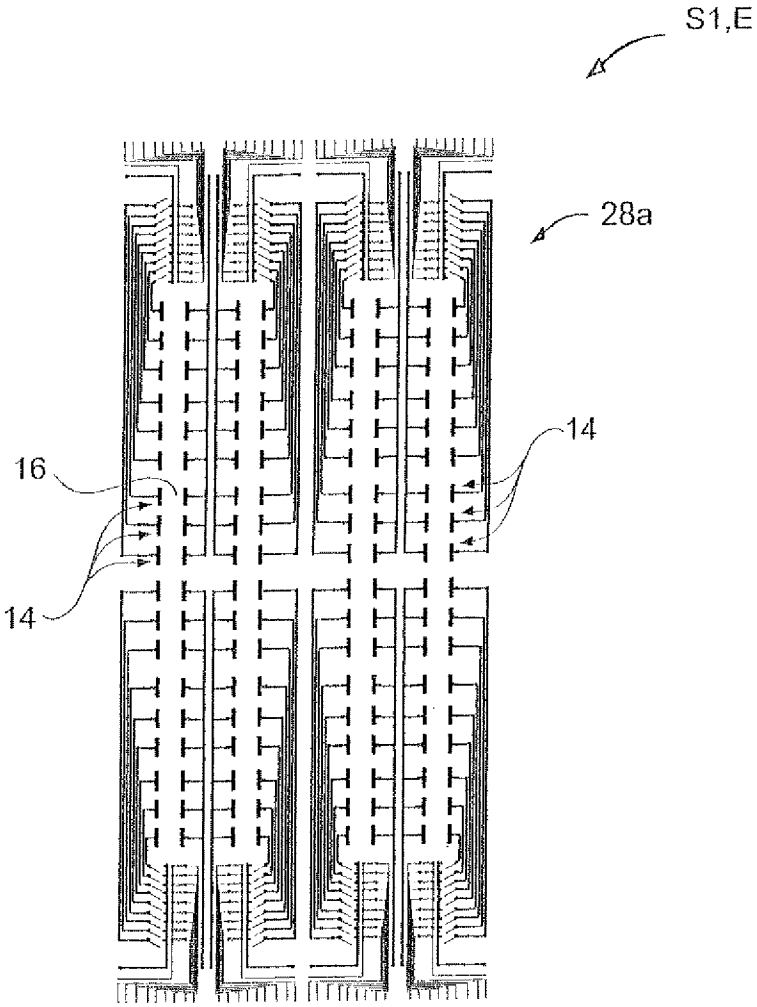
FIG. 7*a* is a diagrammatic circuit diagram of a grid arrangement embodiment of one stage of a plasma drive according to a further embodiment of the present invention.
Figure 7B:
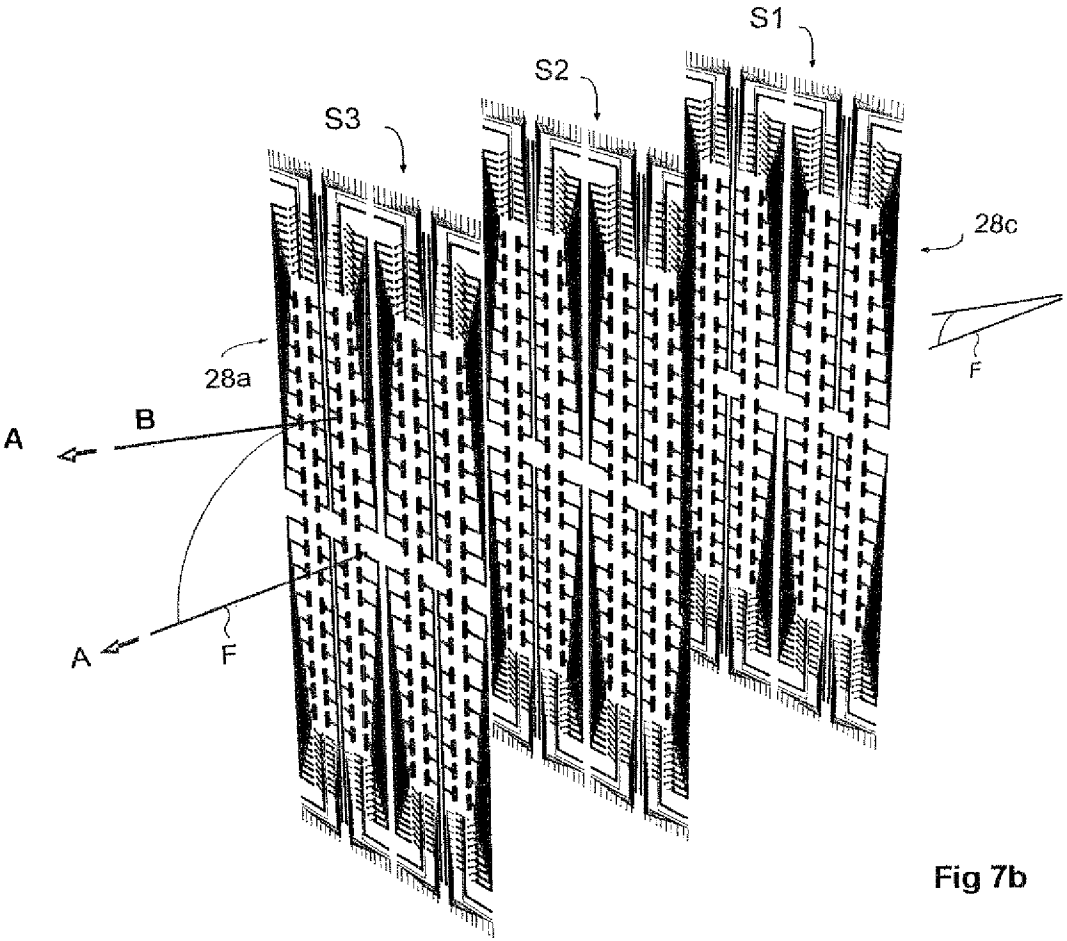
FIG. 7*b* is, in exploded perspective view, a three stage plasma drive employing the circuit diagram of FIG. 7 in each stage.
Figure 7D:
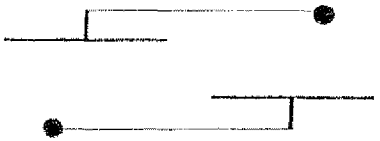
FIG. 7*d* is an enlarged diagrammatic view of a pair of electrodes in an alternative, off-set arrangement.
Figure 7C:
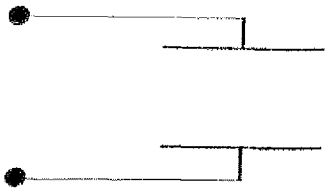
FIG. 7*c* is an enlarged diagrammatic view of a pair of electrodes from FIG. 7*b*.

In the illustration of FIGS. 7*a* and 7*b* instead of each stage S1-S3 having a corresponding ring 10*a*-10*c* of PTs 14, PTs 14 are arranged in grids 28*a*, 28*b* and 28*c*. In the example illustrated. which is not intended to be limiting, each grid 28*a*-28*c*, includes four adjacent and co-planar rectangular grid quadrant arrangements of PTs 14 having corresponding grid and pin addresses. So for example in the view of FIG. 7*a* the rectangular grid quadrant in the upper left hand quadrant of grid 28*a* includes pin addresses S1CC1:1-S1CC1:9, and S1CC2:1-S1CC2:9. Each pin address has its corresponding PT 14 which, when energized as in the example of FIG. 3, ionizes the gas or other plasma fuel in the corresponding gap 16 so as to produce a plasma thrust in a direction substantially perpendicular to the plane, shown as plane E, containing grid 28*a*. Again it will be understood that the grids illustrated in FIGS. 7*a* and 7*b* are expanded for ease of viewing, and would most likely be much more compressed, and each of the stages S1-S3 would be tightly packed in a stack along axis F, wherein axis of symmetry F is orthogonal to plane E, that is orthogonal to the plane containing stage S1.

The pins and corresponding PTs 14 in each grid in each quadrant of grid 28*a* are sequentially energized in a progression which cycles around the grids in each quadrant of grid 28*a* and then switched to stage S2 and corresponding grid 28*b*, and when the sequential energizing in the same progression around the quadrants of grid 28*b* is completed, the sequential energizing of the PTs 14 is switched to grid 28*c* of stage S3, and then looped back to stage S1 to continue the sequential energizing progression of all of the PTs 14 so as to thereby generate a continuous cumulative plasma drive thrust shown diagrammatically by direction arrow A. Alternatively, the sequencing algorithm may be altered to change the direction of the cumulative thrust, for example, as seen in FIG. 7*b*, so as to be directed in direction A' along re-directed thrust axis B. Thus, for example if it was designed to change the direction of the thrust axis B, the concentration of PTs 14 being fired may be increased through the stages along thrust axis B in the desired direction of thrust A'.

In one experiment, timing of the relays was optimized resulting in a noticeable lowering of the power consumption. In the experiment, as the timing became optimized the power consumption of a circular array dropped from 14 W to 9 W. In the experiment the plasma source, that is, the source of resistance, was air. Sequentially triggering of the relays in the array resulted, for lack of a better expression, in a series of bursts of energy 13. The series of bursts could for example be used as a plasma turbine as described above for the arrangement rings of PTs in multiple sequentially triggered stages, where the sequential triggering of the relays (or plasma gates) for each array of PTs and the sequential triggering of each stage, is done at high speeds, using relatively little energy input and no mechanical parts (with the exception of the relay components in embodiments employing relays).

Using an alternating current power source the plasma resolution of the system may be very tightly compressed, providing multiple PT resistance points without having to provide many corresponding ground locations. The use of plasma gates instead of relays or the use of hybrid plasma gates 30, wherein plasma gates are integrated as shown with the electrodes, increases the resolution, and potentially increasing the number of PTs 14 per unit area per stage.

In one experiment multiple relays were positioned around in a non-conductive cylinder. The wires from the relays extended through the cylinder to a gap between the opposing side and the continuation of the electrical circuit. The gap was used to create plasma in the chamber.

A micro controller was programmed to throw the relays one after another, and then release them. The program switched relays every 100 milli-seconds, although this is not intended to be limiting. The distance of the arc between the electrodes was adjusted to establish a functional optimized resistance.

It was found that, even though using AC power, there was an electrical magnetic disturbance that affected the micro controller. Doing more research applicant developed a shielded relay which was protected from electrical energy. Because of the size, speed and function of a relay, a plasma gate switching system as described below may work better for a plasma drive application.

It was found that, by having the relays throw and hold (i.e. pause while energized) for the same amount of time, a better connection resulted. This allowed the use of the original relays which then worked without as many of the problems being caused by electro magnetic disturbance. However, the shielded relays still however worked better than the unshielded ones. Also without shielding, the micro control program that controlled the operation of the relays was still affected by the electro magnetic disturbance.

The relays were successfully operated at interval speeds of approximately four milliseconds, where all plasma connections were operating. The power consumption was observed when using one plasma connection and a meter to observe the wattage. The one connection used 13 watts and when five plasma connections were tested, with the relay connections throwing at 6 milliseconds, the power consumption was reduced to 9 watts. Thus, power savings of approximately 30 percent were obtained. It is anticipated that semi-conductor switches may also be used instead of relays.

As seen in FIG. 8*a*, hybrid plasma gate 30 includes conductor 32 for supplying alternating current or direct current power/ground to electrodes 34*a*. Plasma gate 36 is mounted behind, so as to cooperate with electrodes 34*b*. Electrodes 34*a* are in opposed facing relation to electrodes 34*b* across plasma arc gap 38. Plasma arc's 40 cross gap 38 so as to energize selected electrodes 34*b* by operation of force generators 42. Conductor 44 supplies ac or dc power/ground to plasma gate 36.

Figure 8B:
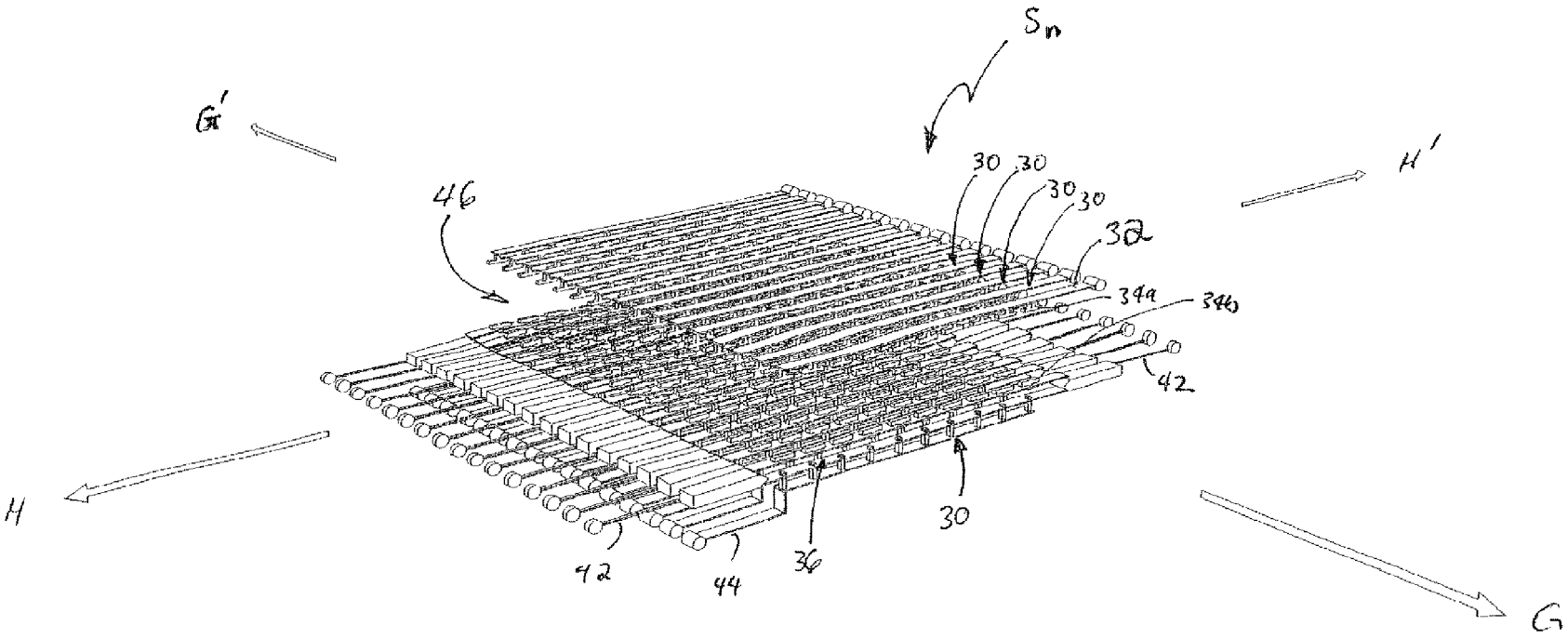
FIG. 8*b* is a single stage comprising an array of the side-by-side hybrid plasma gates of FIG. 8*a*.
Figure 8C:
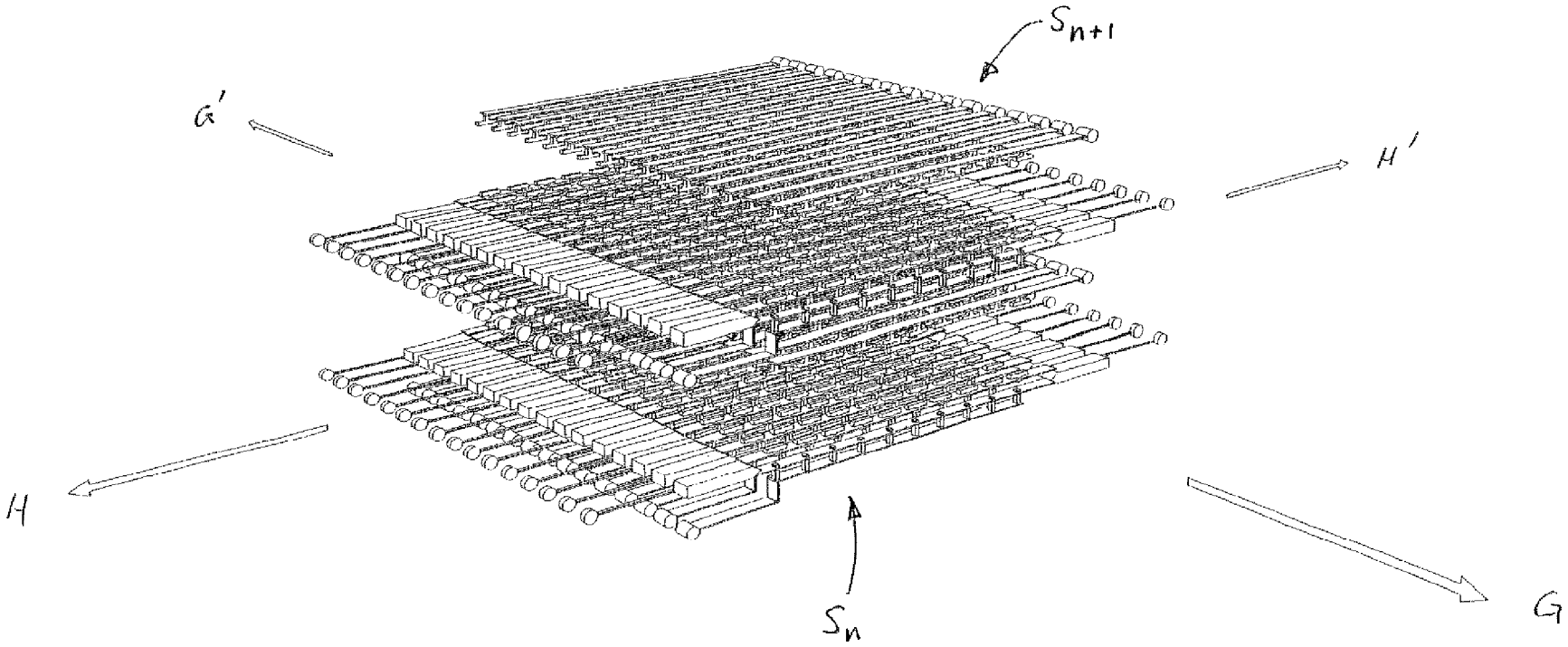
FIG. 8*c* is a two stage stack of two of the stages of FIG. 8*b*.

As seen in FIG. 8*b*, a plasma drive stage Sn, may be formed by an integrated side-by-side array of hybrid plasma gates 30. For the illustrated example stage Sn contains sixteen side-by-side hybrid plasma gates 30, aligned so that plasma gaps 38 for each hybrid plasma gate 30 collectively from a plasma cavity 46 from which thrust may be directed for example in directions G, H, G' or H'. In FIG. 8*c* two stages, Sn and Sn+1, are overlapped one on top of another. Both stages collectively produce thrust for example in one of the illustrated directions. Other embodiments (not shown) may employ more than two overlapped stages, and each stage may include a grid work of multiple arrays of hybrid plasma gates 30.

Plasma Gate for Plasma Drive

The plasma gate described herein and illustrated in FIGS. 9-18 may be characterized in one aspect as including at least one conductive input line having a corresponding at least one terminal end, a plurality of conductive output lines having a corresponding plurality of input ends, and a plasma gap having opposite first and second ends, where the plasma gap extends between the terminal ends of the input lines and the input ends of the output lines. A plasma-generating gas is resident in the plasma gap. At least one field generator having a field-generating distal end is mounted so as to position the distal end of the field generator adjacent the plasma gap. The output lines are arrayed along the plasma gap in a spaced apart array. The distal end of the field generator is positioned at least at the first end of the plasma gap.

In a preferred embodiment the plasma gap is elongate and may be substantially linear, and wherein the input line is an array of input lines. Consequently the at least one terminal end is a corresponding array of terminal ends corresponding to said array of conductive input lines. The plurality of input ends correspond to, and are substantially aligned with, the array of terminal ends. In one embodiment the plasma gap has a lateral width dimension which is constant, and another embodiment where it is not constant. For example the plasma gap may diverge or converge. In the case where the at least one field generator is a single generator field positioned at a first end of the plasma gap, the plasma gap may diverge or converge so as to diverge or converge respectively from the first end to the second end of the plasma gap.

In a further embodiment the at least one field generator includes a pair of field generators in opposed facing relation at the opposite ends of the plasma gap. The pair of field generators may be substantially parallel.

Where the at least one conductive input line is an array of conductive input lines, the at least one terminal end is a corresponding array of terminal ends corresponding to the array of conductive input lines. Preferably the plurality of input ends correspond to, and are substantially aligned with, the array of terminal ends.

The plasma gap may be configured so that it has a center-line extending substantially equidistant between the terminal ends and the input ends. In one embodiment the distal end of at least one field generator is angled relative to the gap center-line. The distal end may be offset from the center-line.

In a plasma gating method employing embodiments summarized above, the method includes the steps of:

a) providing at least one conductive input line having a corresponding at least one terminal end, b) providing a plurality of conductive output lines having a corresponding plurality of input ends, c) providing a plasma gap having opposite first and second ends, the plasma gap extending between the at least one terminal end and the plurality of input ends, and providing a plasma-generating gas in the plasma gap, d) providing at least one field generator having a field-generating distal end mounted so as to position the distal end adjacent the plasma gap, wherein said plurality of conductive output lines are arrayed along the plasma gap in a spaced apart array, and the distal end is positioned at least at the first end of the plasma gap, e) selectively creating a plasma arc across the plasma gap from the at least one terminal end to the plurality of input ends, f) creating a field from the at least one field generator, g) controlling the field so as to control a position of the plasma arc.

Figure 9:
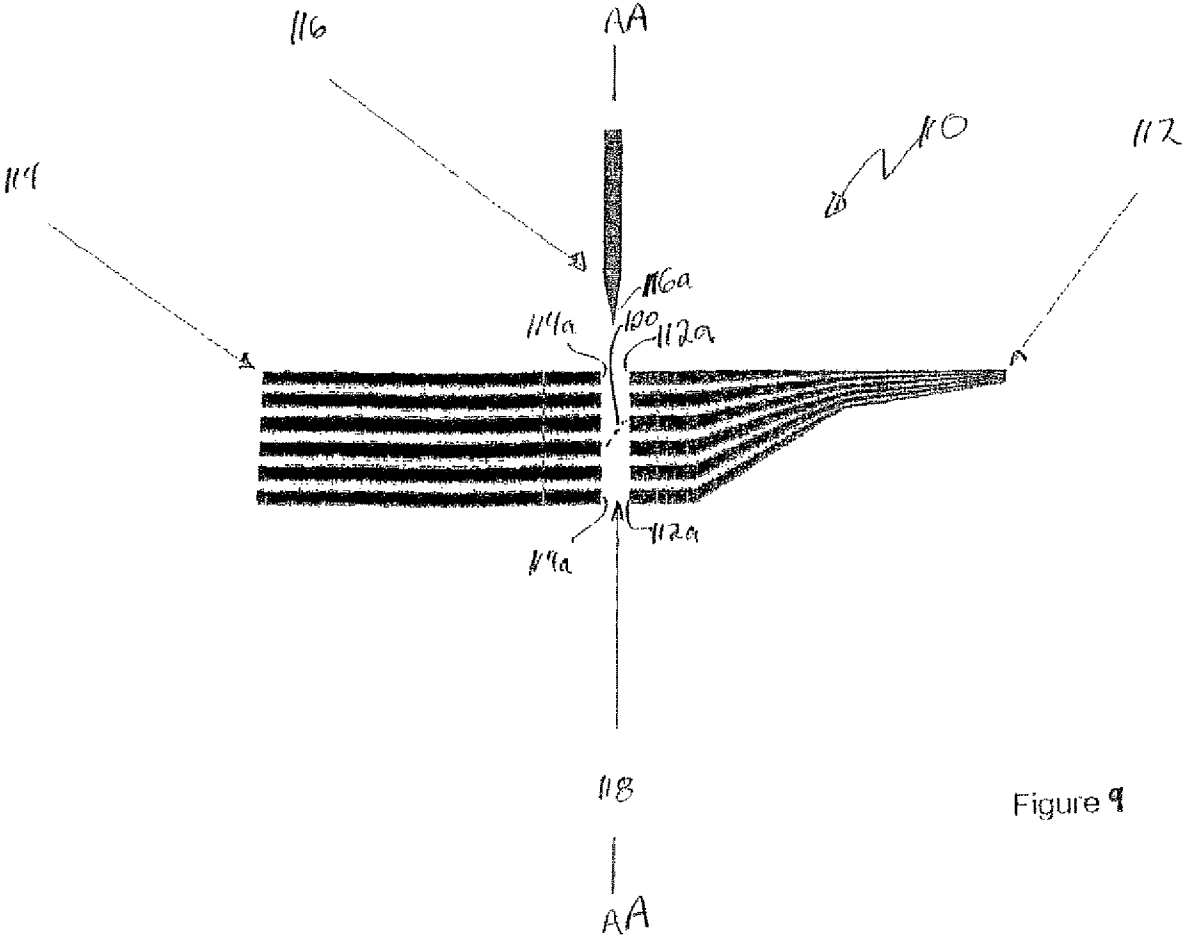
FIG. 9 is a diagrammatic plan view of a junction in a circuit employing one embodiment of a plasma gate.
Figure 10A:
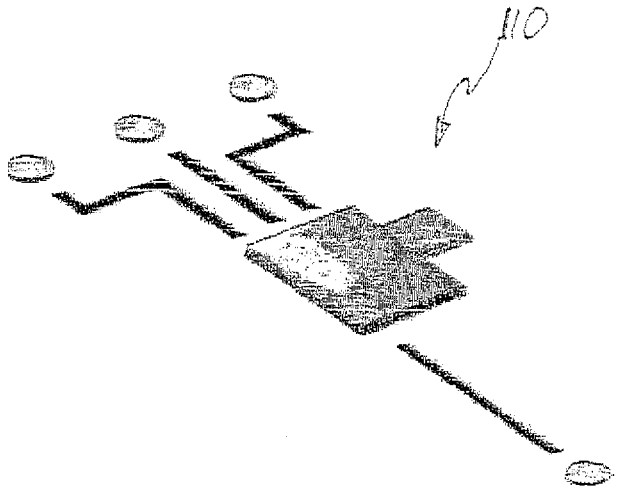
FIG. 10*a* is in perspective view, the junction of FIG. 9 as it may look on a circuit board.
Figure 10B:
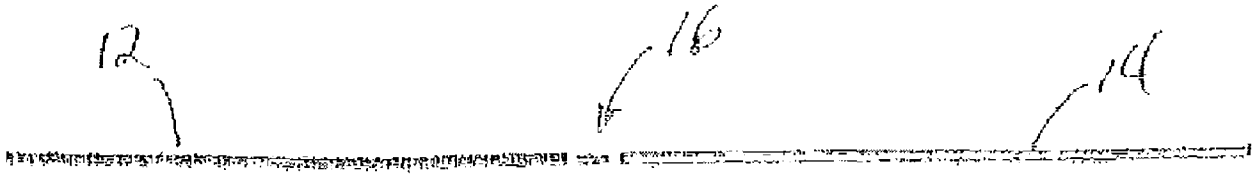
FIG. 10*b* is the circuit junction of FIG. 9 in front view showing the field generator lying in the plane of the inputs and output of the circuit junction.

As illustrated in FIGS. 9-18, for each plasma gate, junction 110, which may for example appear on a circuit board as the junction illustrated in FIG. 10*a*, includes at least one electrically conductive input line 112, wherein each input line 112 has a corresponding terminal end 112*a*, a plurality of electrically conductive output lines 114, each having a corresponding input end 114*a*, and a field generator 116 having a distal end 116*a* positioned adjacent a plasma gap 118 between terminal ends 112*a* and input ends 114*a*. Thus a single or multiple signal paths come into junction 110 on input line(s) 112, and by selectively positioning a plasma arc or bridge 120 across plasma gap 118, the signals are directed to a desired output path 114. Thus by selectively positioning the plasma arc bridging across gap 118 by the use of field generator 116, discreet input lines 112 as applicable and discreet output lines 114 may be selected for any particular signal. The term signal as used herein is intended to mean, and without intending to be limiting, electrical power and correspondingly transmitted data, whether analog or digital. As uses herein the term digital data is not intended to be restricted to binary data.

Testing was initially done in an electron chamber using a neon gas as the plasma gas within the chamber and using an alternating current power source. Experimentation was also done using a direct current power source and using ambient air instead of neon gas. Further experiments confirmed that data from a micro controller (not shown) could be sent and received across a plasma gate substantially as described herein.

Figure 13:
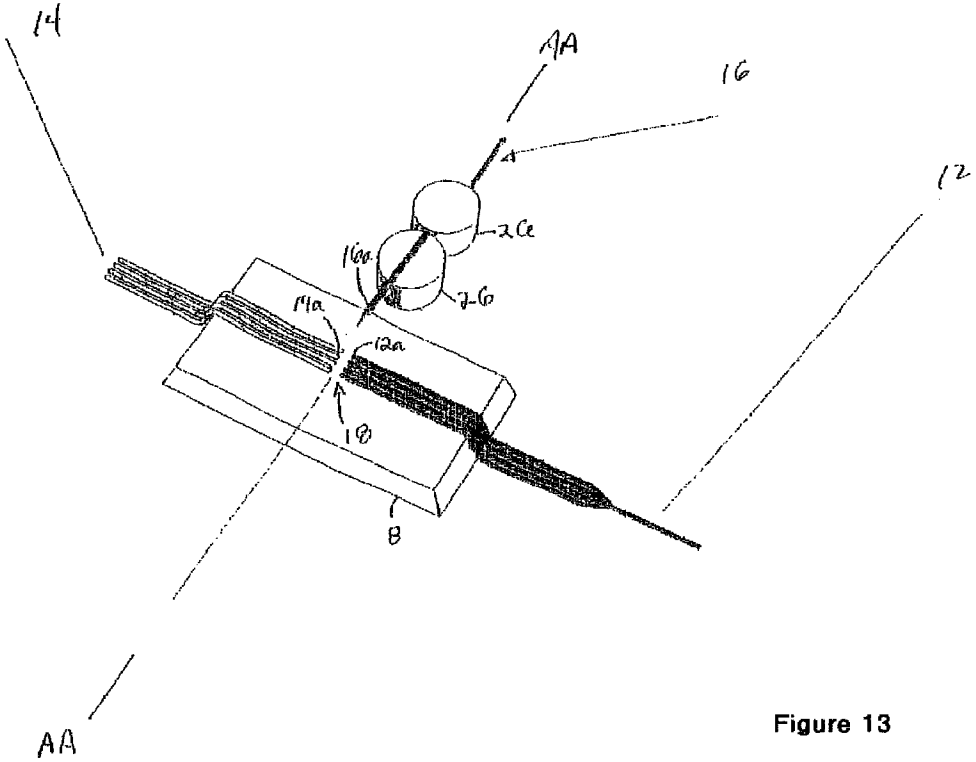
FIG. 13 is a diagrammatic view of a junction in a circuit employing a fourth embodiment of a plasma gate.
Figure 14:
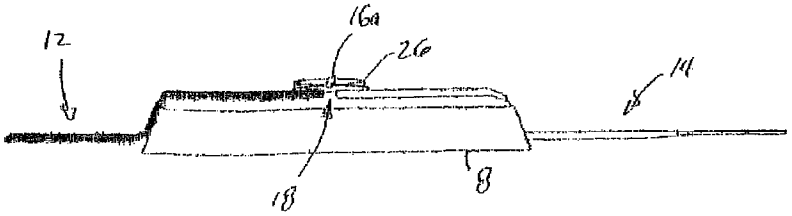
FIG. 14 is a front view of the junction of FIG. 13.

Thus for example in FIG. 13, an elongate, pointed, electrically conductive object, such as a metal nail or spike was successfully employed as a field generator 116. Field generator 116 was positively charged, and in the experiment of FIG. 13, the distal end 116*a* of the field generator was angled so that the point was off to the side of plasma gap 118, that is, offset laterally relative to a centroidal axis AA, wherein axis AA is substantially centroidally aligned along and through plasma gap 118. Plasma gap 118 runs between an opposed-facing pair of substantially parallel arrays of electrical connection points.

With respect to the embodiments of FIGS. 9-13, which not intended to be limiting, with field generator 116 positioned to place distal end 116*a* adjacent one end of plasma gap 118, producing a negative field from field generator 116 repulses or otherwise causes to move away plasma arc or bridge 120, shown by way of example in dotted outline in FIG. 9, from the negative field of the field generator.

It was found advantageous in controlling multiple connections through one junction point to have the positive circuit, for example input line 112, have multiple connection points at ends 112*a* so as to match the opposing negative electrical connections of ends 114*a* across plasma gap 118. Proper spacing of ends 112*a* from ends 114*a*, that is, the spacing between the negative and the positive electrical connections on each side of plasma gap 118, was adjusted so that only one plasma bridge 120 crossed gap 118 when the circuit was energized. The positioning of plasma bridge 120 was accomplished using either a negative or a positive field from field generator 116. Thus when a negative field was generated, the plasma bridge 120 moved away from the negative field generator. With the field turned off the position of the plasma bridge (or arc) 120 was stable and did not move along gap 118. Although not intended to be limited to any particular theory of operation, it is postulated that in this instance the resistance in the first electrical connection has been increased so that the plasma bridge 120 will move to the next path of least resistance in a direction away from the field generator. Conversely, the use of a positive field from field generator 116, attracts plasma bridge 120 so as to connect to an electrical connection closer to field generator 116. Thus manipulating the polarity and strength of the field from field generator 116, allows the controlled switching of plasma bridge 120 along the array or arrays of electrical connections along plasma gap 118.

Figure 11:
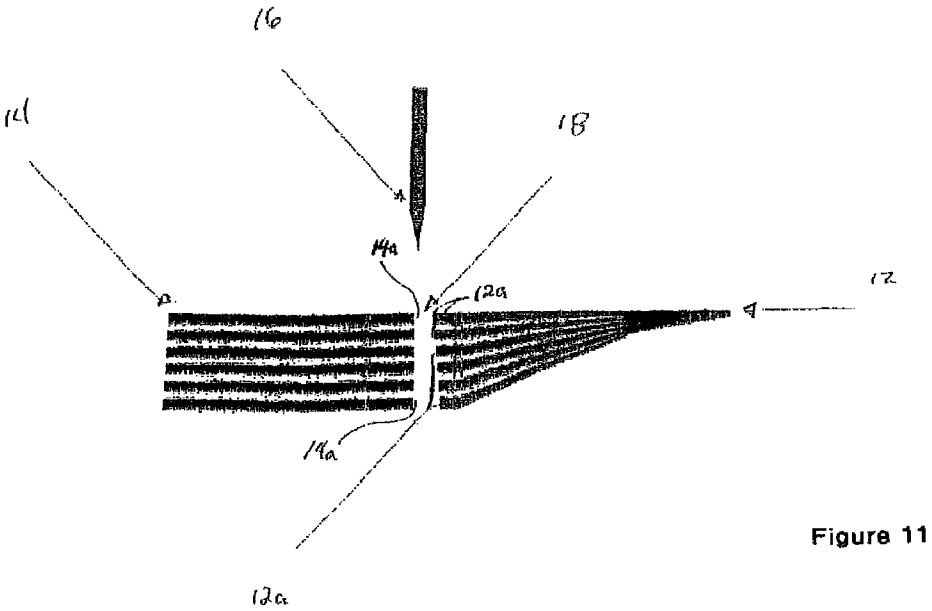
FIG. 11 is a diagrammatic view of a junction in a circuit employing a second embodiment of a plasma gate.
Figure 18:
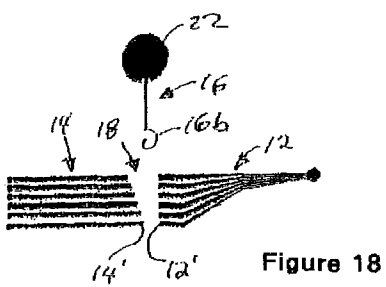
FIG. 18 is a further embodiment of a plasma gate having an energy burst device driving a field generator, wherein the field generator includes a coil.

In the embodiment of FIG. 11, the lateral spacing between ends 112*a* and ends 114*a* is increased, that is plasma gap 118 diverges as the distance increases from field generator 116 along plasma gap 118. This makes a variable distance between the positive and negative connection points across plasma gap 118. Plasma gap 118 diverges in FIG. 11 and converges in FIG. 8, although this is not intended to be limited. Using the configurations of FIG. 2 or 8 it is postulated that the position of plasma bridge 120 may be better controlled because the current will go to the closest spaced connection, because of the least resistance, until a field from field generator 116 pushes plasma bridge 120 away or pulls bridge 120 towards field generator 116 so as to move bridge 120 further away along the arrays of connection points or closer in along the arrays of connection points. However, when no field is being generated by field generator 116, plasma bridge 120 will return to its original position between the laterally closest spaced connection points on ends 112*a* and 114*a*, that is, which are closest to each other across plasma gap 118. Thus in the illustration of FIG. 11, which is not intended to be limiting, the return or original position of plasma bridge 120 is the opposed-facing pair of connection points closest to field generator 116. In FIG. 18 it is the pair of connection points furthest from field generator 116.

Figure 12:
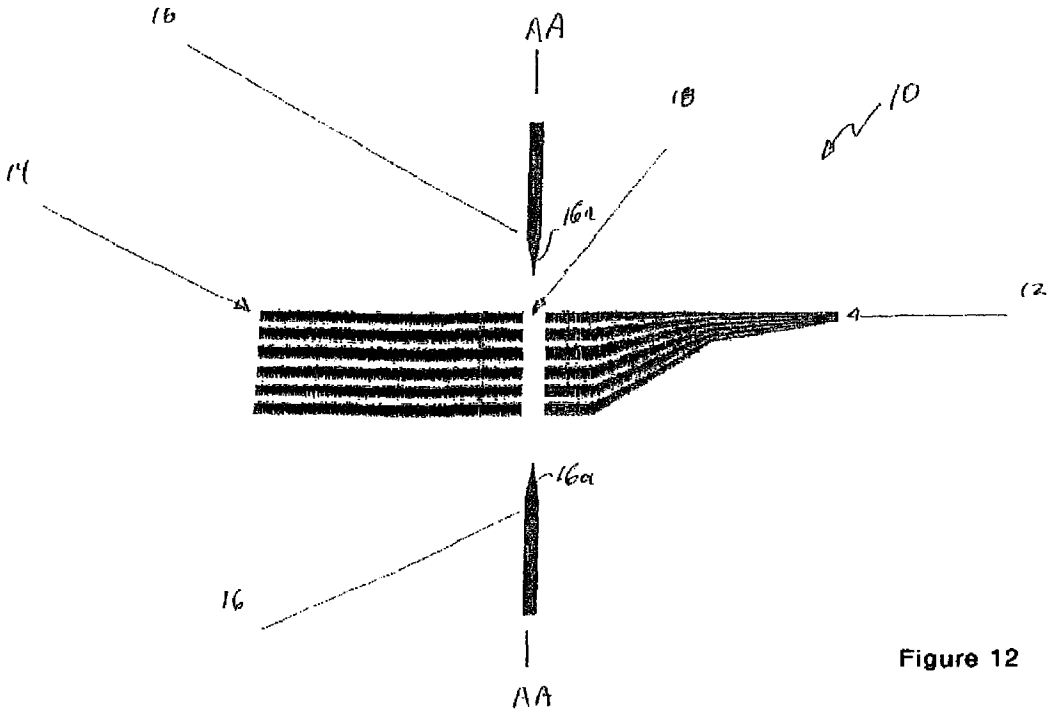
FIG. 12 is a diagrammatic view of a junction in a circuit employing a third embodiment of a plasma gate.

In the embodiment of FIG. 12, an opposed-facing, aligned pair of field generators 116 are positioned on centroidal axis AA, with their corresponding distal ends 116*a* directed into plasma gap 118. It is postulated that this results in more control of the circuit switching as the stability of the position of plasma bridge 120 along plasma gap 118 may be improved so that the connected circuits may be stably held in place and when desired moved along plasma gap 118 with a stationary power factor.

With respect to FIG. 13, in testing it was found that the angled side of distal end 116*a* of field generator 116 had a different polarity or otherwise was different as compared to the arrangements of field generator 116 shown in FIGS. 9-12. The angling of distal end 116*a* towards inputs 114*a* of outputs 114 was found to be more effective for changing the circuits, as switching the circuits through the various input and output lines 112 and 114 respectively, which were mounted on non-conductive base 18, was accomplished with greater ease. The offset point 116*a* of field generator 116 was aimed at inputs 114*a* so as to "push" or urge the plasma arc 120 where it needed to go, i.e., from outputs 112*a* to inputs 114*a*, thereby using less power and establishing the plasma arc 120 more quickly.

Figure 15A:
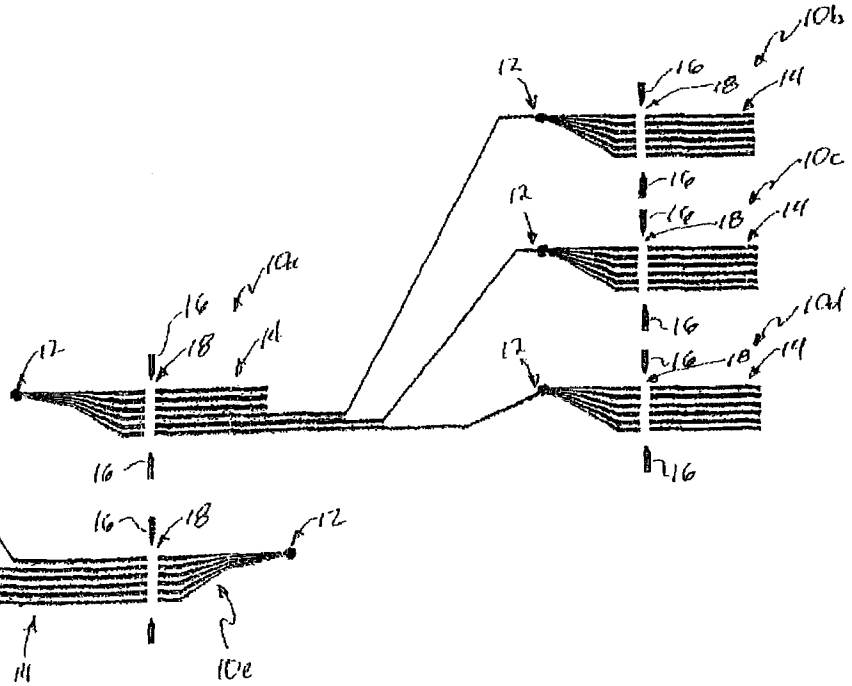
FIG. 15*a* is a network of circuit junctions wherein the plasma gate in the first junction has outputs that correspond to the inputs of the networked second junctions
Figure 15B:
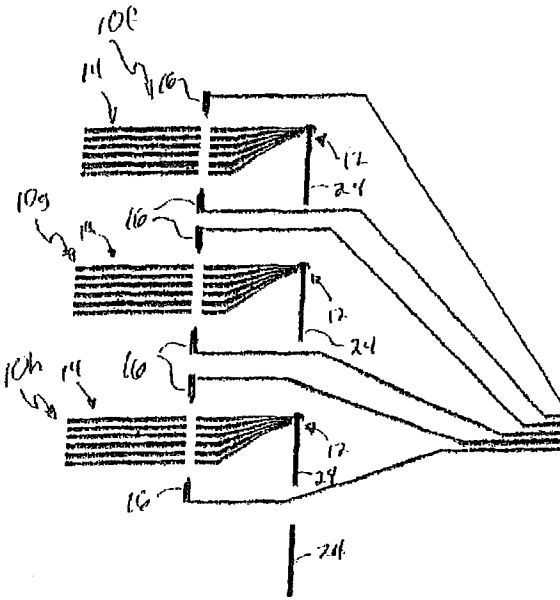
FIG. 15*b* is a network of circuit junctions wherein the plasma gate in the first junction has outputs that correspond to the field generators of the networked second junctions.
Figure 16:
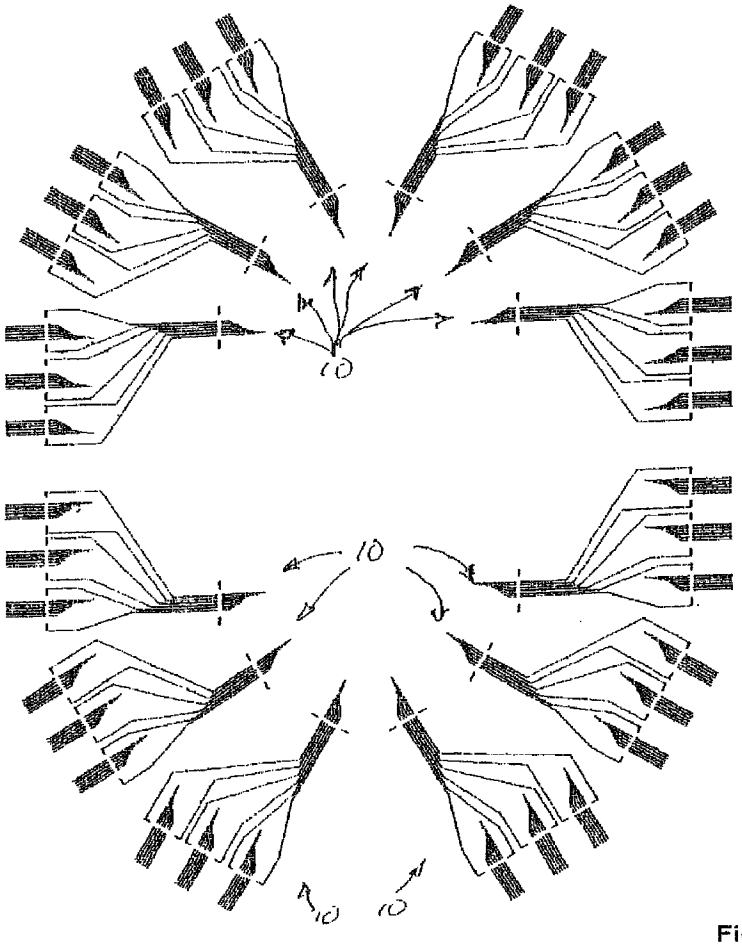
FIG. 16 is an array of the networked circuit junctions of FIG. 5*b*.

Systems such as seen in FIGS. 15*a*, 15*b* and 16 may be employed for switching by first junctions 10 amongst further arrays of junctions 10. Thus as seen in FIG. 15*a*, a first junction 110*a*, which is a version of the junction of FIG. 12 although this is not intending to be limiting, controls output to second junctions 110*b*, 110*c*, and 110*d*. Second junctions 110*b*, 110*c* and 110*d* themselves are each versions of the junction 120 of FIG. 12, although again this is not intended to be limiting as other junctions 110 will also work as is the case with junction 110*a*. Thus second junctions 110*b*, 110*c*, and 110*d* each switch their circuits (circuits inputs 112 and corresponding outputs 114) as controlled by their corresponding field generators 116. As will be understood, the outputs 114 from junction 110*a* may go to a lesser or greater number of second junctions being switched.

As seen in FIG. 15*b*, first junction 110*e* directs its outputs 114 not to the inputs 112 of second junctions 110*f*-110*h*, but to the inputs of the field generators 116 corresponding to second junctions 110*f*-110*h*. In the embodiment of FIG. 15*b* the output of junction 110*e* will, depending on the switch path closed by the operation of the field generators of junction 110*e*, control the switch path which is closed in the corresponding second junction 110*f*, 110*g*, or 110*h*. Pairs of output lines from junction 110*e* lead to corresponding single second junctions, that is, either to junction 110*f*, 110*g* or 110*h*. Each pair of output lines splits so that each output line of the pair powers or otherwise controls the field generated by a corresponding field generator from the opposed-facing pair of field generators on each of junctions 110*f*, 110*g* and 110*h* which control the circuits for a regulated power source 124. Thus it will be appreciated that at any one time, only the field generator on one side or the other of junctions 110*f*, 110*g* and 110*h* will be powered. Because power is supplied by power source 124 to all three of second junctions 110*f*, 110*g*, 110*h*, while the field generators for any one of these three second junctions is controlling/moving the position of the corresponding plasma arc 120, the plasma arcs in the other two second junctions remain stable and live. It will be understood that more than three second junctions may be employed.

FIG. 15*b* may be used for counting plus or minus, i.e., counting up or down (1, 2, etc.) as the circuits sub-divide into time sequences.

In FIG. 16 an array of the junction 110 circuits of FIG. 15*b* are provided to show how the sub-divided sequences may be employed. It is understood that one or more arrays of junctions 110 may be arranged concentrically outwardly (in a functional sense) of the illustrated array so that each output 114 branches to its own further junction 110 and so on creating a network of junctions.

If such a network was to form a building block of for example a digital processor or plasma drive, the sequence of inter-related connections within the network could be programmed, and if any one sequence became damaged for example, then the sequence could be re-routed without the damage impairing the functioning of the network. It is understood that the arrays of junctions 110 could network in three dimensions, and that gaps 118 could thus be two-dimensional gaps between a planar or other two-dimensional array of inputs 112 and a spaced apart, opposed-facing two-dimensional array of outputs 114.

Figure 17A:
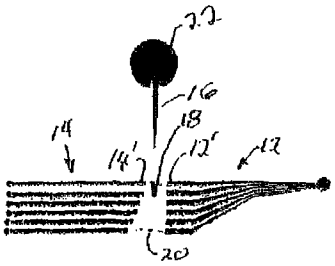
FIG. 17*a* is one embodiment of a plasma gate wherein a pointed field generator is driven by an energy burst device.
Figure 17B:
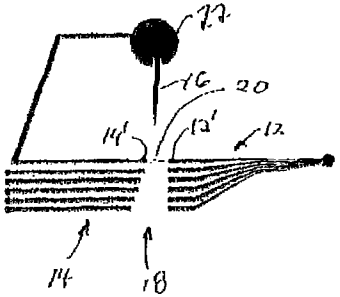
FIG. 17*b* is a further embodiment of the plasma gate of FIG. 7*a* wherein the energy burst device driving the field generator is charged by the plasma gate circuit when in its home position.

The plasma gate could be configured as a counting/time/hertz rate system such as seen in FIGS. 17 and 18. This could be done by using an energy bursting-type device 122 such as a capacitor that stores energy and then releases a burst of energy into the field generator 116, which may in one embodiment as seen in FIG. 18 be a coil-shaped field generator 116*b*. This energy could be controlled by means of using one of its own circuits or it could be energized by a different line or controlled by a separate device. This could be set up so that one burst would energize all the circuits, i.e. all of the individual input lines 112 and output lines 114, in a numerical sequence sequentially, that is, one at a time, and then return to the first circuit (i.e., the first input line 112' and corresponding first output line 114') representing zero. In FIG. 17*a*, energy bursting device 122 energizes a pointed field generator 116 such as used in the embodiment of FIG. 9. In FIG. 17*b* the energy bursting device 122 is charging when the closed circuit is between input 112' and output 114' as illustrated. Once device 122 is charged and releases its energy as a burst, plasma arc 120 is pushed away from filed generator 116, sequentially closing the circuits along plasma gap 118 in direction of the diverging of plasma gap 118. Once the energy has dispersed from device 122, the plasma arc 120 returns to its position 112', 114' closest to field generator 116 while device 122 again charges. The cycle repeats with a frequency which depends on the charge time and pulse time of device 122 and the response time for the plasma arc to return to the home position at 112', 114'. As seen in FIG. 18, advantageously a converging plasma gap 118 may be employed in conjunction with energy burst device 122 and its associated field generator 116*b*, as applicant has observed that a coil-shaped field generator is better at "pulling" plasma arc 120 towards the coil 116*b* than "pushing" plasma arc away from the coil 116*b*.

Of relevance to the present invention are the results of testing of a junction 110 using direct current in the presence of neon gas, wherein the neon gas and junction circuits were contained within a sealed vessel. The sealed vessel was breached with a hair-line crack allowing the escape of some of the neon gas and a small quantity of ambient air into the vessel, and in particular into the plasma gap. From the appearance of the plasma arc across the plasma gap it appeared to applicant that the mixed gas (ambient air mixed with neon gas) worked better. The line of the plasma arc became more pronounced and thinner. Applicant consequently surmises that this would likely allow for the voltage to be reduced to still produce a useful plasma arc.

With respect to the use of magnets 126, seen in FIG. 13, they are illustrated as merely one example of a means for controlling or lowering the voltage at the field generator. Other means for controlling or lowering the voltage may include coils, capacitors, etc., which then provide for more controlled switching amongst the circuits of junction 110.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A plasma drive comprising:

arrays of plasma thrusters, each array comprising multiple plasma thrusters, each array being planar and the arrays being mutually parallel, each array at least partially overlapping another array of the arrays, and each array being non-coplanar with any other array of the arrays, wherein a first array among the arrays is configured to pass thrust carrying propellant through a second array among the arrays.

2. The plasma drive of claim 1, wherein each array further comprises circuitry configured to selectively energize and de-energize the plasma thrusters of the respective array according to a sequence provided by a digital controller.

3. The plasma drive of claim 2, wherein the sequence comprises a serial sequence consisting of each plasma thruster of the respective array firing individually and once per execution of the serial sequence.

4. The plasma drive of claim 3, wherein the serial sequence progresses from the currently firing thruster among the plasma thruster of the respective array to a nearest neighbor among the plasma thruster of the respective array.

5. The plasma drive of claim 2, wherein the sequence comprises a first and a second serial sequence respectively for the first and the second array among the arrays, wherein each serial sequence consists of each plasma thruster of each respective array firing individually and once per execution of the respective serial sequence, wherein each serial sequence progresses from the currently firing thruster among the plasma thruster of the respective array to a nearest neighbor among the plasma thruster of the respective array, and wherein the first and second serial sequence alternate in execution.

6. The plasma drive of claim 2, wherein the sequence comprises all plasma thruster of the respective array firing simultaneously.

7. The plasma drive of claim 2, wherein the sequence comprises a first and a second parallel sequence respectively for the first and the second array among the arrays, wherein each parallel sequence consists of each plasma thruster of each respective array firing simultaneously, and wherein the first and second parallel sequence alternate in execution.

8. The plasma drive of claim 1 wherein said plasma thrusters in each array are organized in an arrangement chosen from the group of arrangements comprising: a conic section, a grid, side-by-side conic sections, side-by-side grids, concentric conic sections, a combination of concentric and side-by-side conic sections, wherein said conic sections include circles.

9. The plasma drive of claim 8 wherein each array produces a respective thrust vector parallel to a target thrust vector.

10. The plasma drive of claim 9 wherein said each array is symmetrical about said target thrust vector.

11. The plasma drive of claim 10 wherein, in said conic section is a ring.

12. The plasma drive of claim 10 wherein, in said grid tetragon.

13. The plasma drive of claim 11 wherein said ring is circular.

14. The plasma drive of claim 12 wherein said tetragon is a trapezoid.

15. The plasma drive of claim 14 wherein said trapezoid is substantially rectangular.

16. The plasma drive of claim 1 wherein each said plasma thruster is electrically actuated by at least one plasma gate, and wherein each plasma gate of said at least one plasma gate comprises:

at least one conductive input line having a corresponding at least one terminal end, a plurality of conductive output lines having a corresponding plurality of input ends, a plasma gate gap having opposite first and second ends, said plasma gate gap extending between said at least one terminal end and said plurality of input ends, wherein a plasma-generating gas is resident in said plasma gate gap, at least one field generator having a field-generating distal end mounted so as to position said field generating distal end adjacent said plasma gate gap, wherein said plurality of conductive output lines are arrayed along said plasma gate gap in a spaced apart array, and said field generating distal end is said positioned at least at said first end of said plasma gate gap.

17. The plasma drive of claim 16 wherein said plasma gate gap is elongate and wherein said at least one conductive input line is an array of conductive input lines and wherein consequently said at least one terminal end is a corresponding array of terminal ends corresponding to said array of conductive input lines, and wherein said plurality of input ends correspond to, and are substantially aligned with, said array of terminal ends.

18. The plasma drive of claim 17 wherein said plasma gate gap is substantially linear.

* * * * *